US005344537A

United States Patent [19]

Fabricius

[11] Patent Number: 5,344,537

[45] Date of Patent: Sep. 6, 1994

[54] METHOD FOR CORROSION-PROOFING OF A WATER SYSTEM

[75] Inventor: Claus Fabricius, Allerod, Denmark

[73] Assignee: Guldager Electrolyse A/S, Allerød, Denmark

[21] Appl. No.: 30,203

[22] Filed: Mar. 25, 1993

[51] Int. Cl.[5] ..... C23F 13/00

[52] U.S. Cl. ..... 204/147; 204/149

[58] Field of Search ..... 204/149, 147

[56] References Cited

U.S. PATENT DOCUMENTS 4,011,151 3/1977 Ito et al. ..... 204/149

FOREIGN PATENT DOCUMENTS 0231100 8/1987 European Pat. Off. .
1902365 8/1970 Fed. Rep. of Germany .
13,522 of 1908 United Kingdom .

OTHER PUBLICATIONS

Patent Abstracts of Japan, vol. 12, No. 198, C502, Abstract of JP 62-298491, publ. Dec. 25, 1987.

*Primary Examiner*—John Niebling
*Assistant Examiner*—Kishor Mayekar
*Attorney, Agent, or Firm*—Jacobson, Price, Holman & Stern

[57] ABSTRACT

An apparatus and method for electrolytically corrosion-proofing a water system comprising. At least two electrodes are fitted in a tank through which water flows. One of said electrodes comprises the metal aluminum and serves as the cathode. An electrolytic power source is connected to the electrodes. The cathode may also comprise a metalloid element, such as silicon.

2 Claims, No Drawings

METHOD FOR CORROSION-PROOFING OF A WATER SYSTEM

BACKGROUND OF THE INVENTION

The present invention relates to a method for corrosion-proofing of a water system of the type specified in the introduction to the claim.

Soluble anodes are used in prior art systems for electrolytic water treatment. Such anodes in controlled quantities depending on water consumption form anodic material salts which are passed to the following pipe system with the effect that if e.g. aluminium is used, a cathodic inhibitor is formed which has a tendency to precipitation on the metal surfaces.

If the same method is used, a potential-determined contact is obtained at the prior art electrolyses between the anions of the water and the positively charged aluminium cation formed at the anode with salt formation thereon which often has a tendency to precipitation so that flocculation can be made with the result that the total salt content in the water is reduced. This type of system is used primarily for industrial plants and especially for process water.

The use of prior art technology creates a problem if the water content of active anions is high as the production of anodic aluminium ions has to be related to the anion content in the water if a surplus of active aluminium hydroxide is required which is to prevent corrosion in a pipe system. It has, therefore, been experienced that dissolution of the anodic aluminium is to be controlled by the parameters of the water; not just the above-mentioned cations, but also the water temperature which affects the reaction tendency between the ions. There are prior art examples that the amperage—and thus the solution contingent on Faraday—is to be increased by factor 10 in order that every liter of treated water can have a required aluminium hydroxide content in order that the corrosion-proofing effect can be obtained at a temperature difference of approx. 50° C. which is normal between cold and hot tap water. This factor implies that the treatment of hot water creates a considerable formation of sludge which it must be possible to remove expediently from the water. The effect is that the construction of the water installation has to pay special attention hereto as it is not desirable that sludge should pass to the pipe system. For the same reason, electrolytic water treatment normally requires a minimum water treatment time of 20 minutes which has proved adequate to secure flocculation and sedimentation.

If the water is also calcareous, the increased current as mentioned above also has the effect that a strong pH-conditional precipitation requiring regular cleaning will occur on the cathode surfaces of the plant. Besides, the content of anions in the water will have a tendency to passivate the relatively large surface of the aluminium anode. Especially phosphate and silicate may give trouble.

SUMMARY OF THE INVENTION

According to the present invention a total change is proposed which has proved to have a surprisingly positive effect and to have solved the above problems effectively. It is characteristic according to the invention that the cathode of the electrolysis plant consists, in whole or in part, of an alkali-sensitive metal or metalloids.

Depending on the function of the plant, the anode may consist of a soluble and/or insoluble anode. However, what is decisive is the cathode reactions where it is known that when water is disintegrated, OH— is formed of the metal surface itself, i.e. a base which dissolves the sensitive metal electrochemically during formation of a negative ion, $Al(OH)_4^-$.

With a suitable negative potential on the cathode and calm flow conditions it will, in theory, be possible to dissolve 1 mol aluminium at 1 Faraday ( 96,500 coulomb) corresponding to the one dissolved anodically where 3 Faraday is required to form 1 mol aluminium.

The cathodically formed $Al(OH)_4$ ion has proved to act as an effective inhibitor with a great tendency to precipitate on anodic metal surfaces and form a layer on the anodic zones of the system in a short time, i.e. in all the places with active corrosion.

Many examinations have affirmed that this layer formation includes other anions which clearly have a synergic effect with aluminium. Typically, the silicate content of the water is important where a complex combination of this content and the cathodic aluminium is precipitated in equivalent quantities, irrespective of the very large concentration differences between the salts, typically a factor of 200–400 at normal water qualities.

The very great advantage of the method is that considerably less aluminium can be used than with traditional electrolysis because the $Al(OH)_4$ ion does not have the same tendency to flocculation and precipitation as the positive aluminium ion which in small concentrations is unable to act as a cathodic inhibitor in the presence of strong anions like phosphate and silicate. It also means that, as known from anodically dissolved aluminium, there is no need for the previously mentioned treatment time, but that the treatment tank that has been necessary for the prior art technology can be left out and a small electrolysis cell can be mounted in its place.

So it can be said in conclusion that anodically dissolved aluminium does not act as an effective corrosion inhibitor without 'auxiliary ions', and an effect is, therefore, completely dependent on the water quality conversely the method according to the invention.

If the water does not contain silicon, it may, for example, be of advantage to use alloys consisting of aluminium and silicon where the advantage is that the presence of the latter metalloid-like element in the water reduces the need for aluminium.

The invention can be practised in a tank like an enclave if for other reasons the tank is mounted in the installation, e.g. a hot-water tank or a pressure storage tank, or in an independent tank mounted in a part flow or full flow.

The selection of anode is determined by the concrete demand on the water treatment. In drinking water systems it will often be an advantage to use insoluble anodes which by virtue of the anode process will form oxygen which can secure a reasonable oxygen content in the water and thus a quality of freshness. For industrial use, it will often be an advantage to use soluble anodes because flocculation is normally required in such plants.

I claim:

1. A method for corrosion-proofing a water system having a tank through which water flows in whole or in part, the method comprising the steps of:

providing at least two electrodes in the tank, at least one of said electrodes comprising a metal aluminum and serving as a cathode;

connecting the electrodes to an electrolysis power source; and energizing the electrodes for electrolytically treating the water in the tank and thereby corrosion proofing the tank.

2. The method of claim 1, wherein said cathode further comprises silicon.

* * * * *